United States Patent [19]

Okushima et al.

[11] Patent Number: 4,863,843

[45] Date of Patent: Sep. 5, 1989

[54] SILVER HALIDE PHOTOGRAPHIC EMULSION CONTAINING PREDOMINANTLY SILVER BROMIDE

[75] Inventors: Masao Okushima; Katsuaki Iwaosa; Susumu Baba; Tokitsugu Houjo, all of Nagaokakyo, Japan

[73] Assignee: Mitsubishi Paper Mills, Ltd., Tokyo, Japan

[21] Appl. No.: 792,021

[22] Filed: Oct. 28, 1985

[30] Foreign Application Priority Data

Oct. 30, 1984 [JP] Japan ..... 59-228194
Oct. 30, 1984 [JP] Japan ..... 59-228195

[51] Int. Cl.[4] ..... G03C 1/10; G03C 1/16; G03C 1/18; G03C 1/34

[52] U.S. Cl. ..... 430/566; 430/567; 430/583; 430/588; 430/576; 430/603; 430/607

[58] Field of Search ..... 430/566, 567, 570, 576, 430/581, 586, 607

[56] References Cited

U.S. PATENT DOCUMENTS

| | | | |
|---|---|---|---|
| 742,405 | 10/1903 | Eichengrün | 430/566 |
| 2,444,605 | 7/1948 | Heimbach et al. | 430/615 |
| 2,835,581 | 5/1958 | Tinker et al. | 430/615 X |
| 3,312,550 | 4/1967 | Stewart et al. | 430/566 X |
| 3,466,173 | 9/1969 | Ishikawa et al. | 430/566 X |
| 3,993,490 | 11/1976 | Schober et al. | 430/566 X |
| 4,175,966 | 11/1979 | Fujiwhara et al. | 430/566 X |
| 4,336,321 | 6/1982 | Kanada et al. | 430/566 X |
| 4,410,619 | 10/1983 | Kubbota et al. | 430/566 X |
| 4,419,433 | 12/1983 | Kubbota et al. | 430/538 X |

OTHER PUBLICATIONS

T. H. James, The Theory of the Photographic Process, 4th edition, pp. 398–399, 1977.

*Primary Examiner*—Richard L. Schilling

*Attorney, Agent, or Firm*—Cushman, Darby & Cushman

[57] ABSTRACT

A silver halide photographic emulsion comprising as major constituent silver bromide with improved gradation, density and sensitivity and decreased fog is disclosed. This emulsion contains at least one of the compounds represented by the general formula

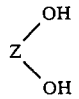

(A)

wherein Z represents an aromatic radical, or of the oxidized derivatives thereof, and at least one of the compounds represented by the general formula

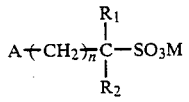

(B)

wherein A represents a hydroxyl group, an amino group,

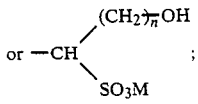

;

$R_1$ and $R_2$ form a ring jointly with the carbon atom to which $R_1$ and $R_2$ are attached or one of $R_1$ and $R_2$ represents a hydrogen atom and the other represents a hydrogen atom, an alkyl group, an aryl group, or a hydroxyl group; n is 0 or an integer of 1 to 8, and M represents a hydrogen atom or an alkali metal.

13 Claims, No Drawings

SILVER HALIDE PHOTOGRAPHIC EMULSION CONTAINING PREDOMINANTLY SILVER BROMIDE

BACKGROUND OF THE INVENTION

This invention relates to silver halide photographic emulsions. More particularly, it relates to silver halide photographic emulsions which are improved in sensitivity, gradation, fog, density, and time-depending stability.

There have heretofore been known various methods for increasing the sensitivity of silver halide photographic emulsions. As examples, mention may be made of generally known noble metal sensitization which employs compounds of noble metals such as gold, platinum, and iridium; sulfur sensitization employing sulfur compounds such as thiourea, sodium thiosulfate, and the like, reduction sensitization using stannous salts, polyamines, and hydrazine derivatives; and development acceleration by use of quaternary ammonium salts and polyalkylene glycols. It is also well known that more sensitive silver halide photographic emulsions are obtained by applying the above methods of sensitization to the silver halide emulsions comprising silver bromide as major constituent, especially silver bromide of increased grain size. Such an emulsion, however, has a disadvantage of soft tone, being low in maximum density. A common technique used in increasing the contrast, such as, for example, the well known addition of a rhodium salt accompanies desensitization and, in addition, is not sufficiently effective for the silver halide emulsion containing silver bromide as major constituent. Such desensitization cannot be compensated by chemical sensitization, because intensive chemical sensitization causes fogging, which imposes a limit upon the attainable sensitivity. One of the methods to attain a high maximum density with unit amount of silver halide is to use a fine grain emulsion. This method, however, accompanies also a decrease in sensitivity.

Spectral sensitization (optical sensitization) is a well-known technique to extend the sensitive region of silver halide to a longer wavelength region of the spectrum. For this purpose, there are known a great variety of sensitizing dyes such as cyanine dyes and merocyanine dyes. Although various performance characteristics are required for the sensitizing dyes, general requirements are a sufficiently high sensitivity in the intended sensitive region and the complete decoloration of the dye after completion of the photographic processing. As the dyes which meet such requirements, there are known cyan dyes having a water-soluble sulfoalkyl group at position 3 (and 3'), that is, cyanine dyes of the betaine type (and anionic type). However, because of its comparatively low adsorbability, such a cyanine dye tends to be hindered from adsorption onto the silver halide grains by the presence of an antifoggant, particularly an organic compound having a mercapto group, which is used to alleviate the fogging caused by the chemical sensitization. The sensitivity (spectral sensitivity) imparted by the sensitizing dye becomes gradually decreased with time, especially with time elapsed before coating on a support, and, in an extreme case, becomes substantially null.

SUMMARY OF THE INVENTION

An object of this invention is to provide a silver halide photographic emulsion containing silver bromide as major constituent, which is improved in gradation (high contrast), density (high maximum density), fog (decreased fog), and sensitivity (increased sensitivity).

Another object of this invention is to provide a spectrally sensitized silver halide photographic emulsion, which has the said characteristics and, in addition, improved time-depending stability.

DESCRIPTION OF THE INVENTION

The objects of this invention have been achieved by a silver halide photographic emulsion comprising as major constituent silver bromide of 0.5 μm or above in average grain size, which is characterized by containing at least one of the compounds represented by the general formula

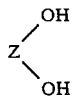

(A)

wherein Z represents an aromatic radical, or of the oxidized derivatives thereof, and at least one of the compounds represented by the general formula

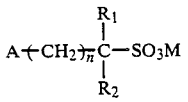

(B)

wherein A represents a hydroxyl group, an amino group,

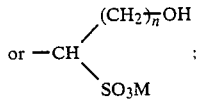

$R_1$ and $R_2$ form a ring jointly with the carbon atom to which $R_1$ and $R_2$ are attached or one of $R_1$ and $R_2$ represents a hydrogen atom and the other represents a hydrogen atom, an alkyl group, an aryl group, or a hydroxyl group; n is 0 or an integer of 1 to 8; and M represents a hydrogen atom, ammonium or an alkali metal.

The silver halide photographic emulsion of this invention is preferably spectrally sensitized with a cyanine sensitizing dye of the betaine type or anionic type represented by the general formula

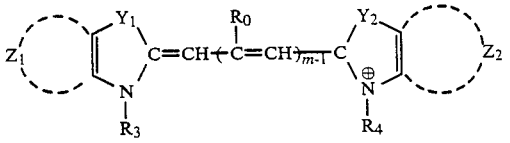

(C)

wherein $Y_1$ and $Y_2$ represent each an oxygen, sulfur, or selenium atom, a $>N-R_5$ group, $R_5$ being an alkyl group, or a

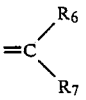

group, $R_6$ and $R_7$ being each an alkyl group; $R_0$ represents a hydrogen atom, an aryl group, an aralkyl group, or an alkyl group; $R_3$ and $R_4$ represent each an alkyl group, an aryl group, or an allyl group, which groups may be substituted, at least one of $R_3$ and $R_4$ having a sulfo group as substitutent; $Z_1$ and $Z_2$ represent each a group of non-metallic atoms necessary for forming a benzene or naphthalene nucleus which may be substituted; and m is 1 or 2.

The spectrally sensitized silver halide photographic emulsion of this invention preferably contains a specific hydroxytetraazaindene represented by the general formula (D)

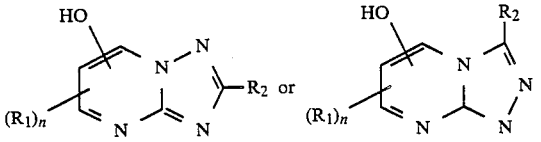

wherein $R_1$ and $R_2$ represent each a hydrogen atom, an aliphatic group, or an aromatic group, provided that at least one of $R_1$ and $R_2$ is an aryl group or an alkyl group and the total number of carbon atoms of $R_1$ and $R_2$ is 3 to 8, and n is 1 or 2.

The invention is described in detail below.

Typical examples of compounds represented by general formula (A) used in this invention are as shown below.

(A-1)

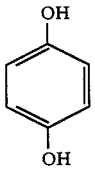

(A-2)

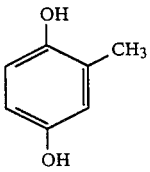

(A-3)

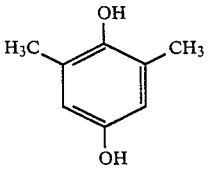

(A-4)

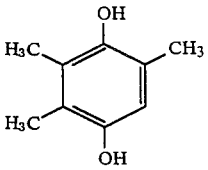

(A-5)

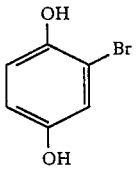

-continued (A-6)

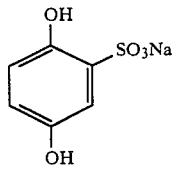

(A-7)

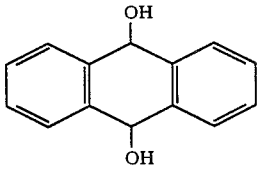

(A-8)

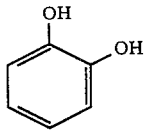

(A-9)

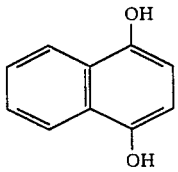

(A-10)

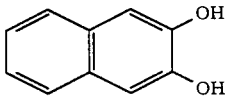

(A-11)

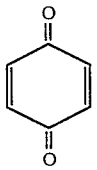

(A-12)

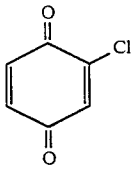

(A-13)

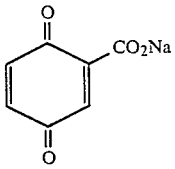

(A-14)

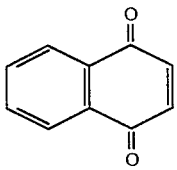

-continued (A-15)

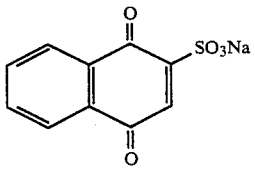

Typical examples of compounds represented by general formula (B) used in this invention are as shown below.

$HO-CH_2-SO_3Na$ (B-1)

(B-2)

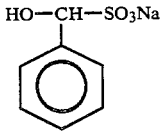

(B-3)

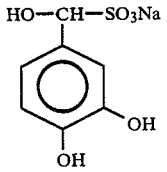

$HO-(CH_2)_2-SO_3K$ (B-4)

(B-5)

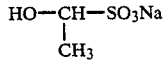

$HO-(CH_2)_6-SO_3NH_4$ (B-6)

(B-7)

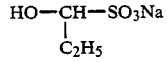

(B-8)

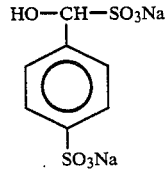

(B-9)

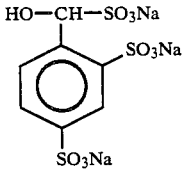

(B-10)

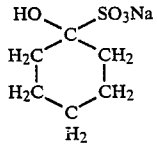

(B-11)

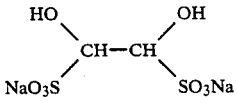

$H_2N-CH_2-SO_3Na$ (B-12)

-continued $H_2N-CH-SO_3Na$ (B-13)

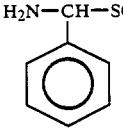

$H_2N-CH-SO_3Na$ (B-14)

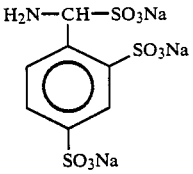

Compounds of the general formula (A) are those which are known as developing agents generally used in processing silver halide black and white photographic materials. It is also known that such compounds can be incorporated in the emulsion layer [e.g. Japanese Patent Application "Kokai" (Laid-open) Nos. 832/72, 11,029/77, and 95, 729/83]. These compounds are added to the silver halide photographic emulsion during manufacture of the latter at any time after desalting, generally after chemical ripening. The amount to be added is 0.01 to 0.5, preferably 0.05 to 0.3, mole per mole of silver halide.

Compounds of the general formula (B) are known to be capable of preventing the developing agent from discoloration by adding the compounds to the paper sheet of a polyethylene coated paper support [e.g. Japanese Patent Application "Kokai" (Laid-open) Nos. 832/72 and 95,729/83]. It is also known that when the compounds are included in a silver halide emulsion layer, the stability of the emulsion in storage is improved [e.g. Japanese Patent Application "Kokai" (Laid-open) No. 163,935/83]. The compounds of the general formula (B) are added to the silver halide photographic emulsion during manufacture of the emulsion at any time after desalting, generally after chemical ripening. The amount to be added is 0.001 to 0.5, preferably 0.003 to 0.3, mole per mole of silver halide.

The silver halide of the present photographic emulsion contains silver bromide as major constituent, the silver bromide content being 50 mole-% or more, preferably 80 to 100 mole-%, and may contain up to 5 mole-% of silver iodide. Therefore, the silver halide is composed of silver bromide, silver chlorobromide, silver iodobromide, and silver chloroiodobromide. The average grain size of the silver halide is at least 0.5 μm, preferably 0.55 μm or above. The shape of the silver halide grain is optional. In precipitating the silver halide, any of the known processes may be used, such as, for example, ammonia process, neutral process, acid process and semi-ammonia process which is a mixed ammonia-neutral process. Mixing can be performed by regular procedure, reversed procedure, or simultaneous procedure. There may be used so-called double jet procedure which is a simultaneous mixing procedure to control the crystal habit of silver halide by regulating the pAg. The conversion technique utilizing the solubility difference may also be used. Such a type of emulsion preparation is described, for example, in U.S. Pat. No. 2,592,250. An emulsion prepared in the presence of a crystal habit regulator, as described in J. Phot. Sci., 21, 39–50 (1973) can also be used. A metal such as rhodium or iridium can be used during the precipitation or physical ripening of the silver halide.

The emulsion may be subjected to chemical ripening in a known manner, such as sulfur sensitization by use of sulfur compounds or a sensitizing gelatin containing sulfur compounds, as described in U.S. Pat. Nos. 1,574,944, 2,278,947, 2,410,689, 3,189,458, and 3,501,313; gold sensitization using gold compounds described in U.S. Pat. Nos. 2,597,856, 2,597,915, and 2,399,083; noble metal sensitization using salts of noble metals such as platinum, palladium, rhodium, iridium, and ruthenium, as described in U.S. Pat. Nos. 2,448,060, 2,566,245, and 2,566,263; and reduction sensitization as described in U.S. Pat. Nos. 2,518,698, 2,521,925, 2,487,850, and 2,694,637. These methods of sensitization are used each alone or in combinations.

The sensitizing dyes useful in the practice of this invention are those represented by the general formula,

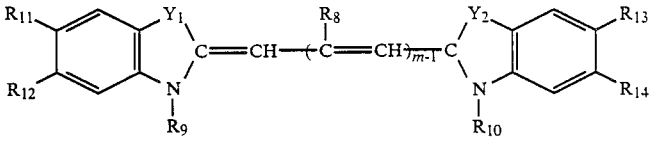

(C-I)

wherein $R_8$ represents a hydrogen atom or an alkyl group; $R_9$ and $R_{10}$ represent each an alkyl group which may be substituted, provided that at least one of $R_9$ and $R_{10}$ is a sulfoalkyl group; $R_{11}$ to $R_{14}$ represent each a hydrogen atom, a halogen atom, a lower alkyl group, a lower alkoxy group, a lower alkoxycarbonyl group, a carboxyl group, or a hydroxyl group; and $Y_1$, $Y_2$, and m are as defined previously with respect to the general formula (C).

Typical examples of sensitizing dyes used in this invention are as shown below.

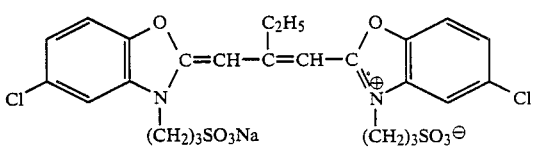

(C-1)

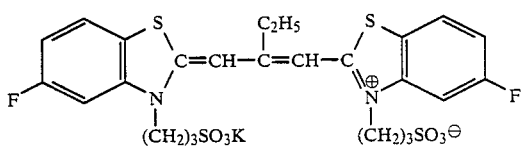

(C-2)

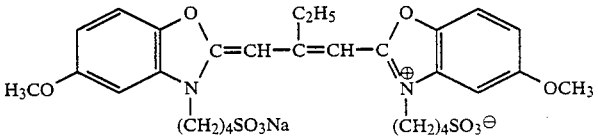

(C-3)

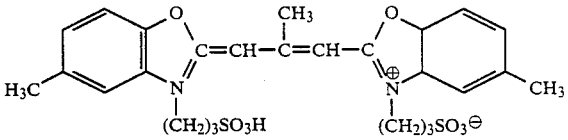

(C-4)

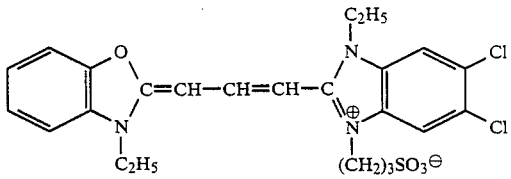

(C-5)

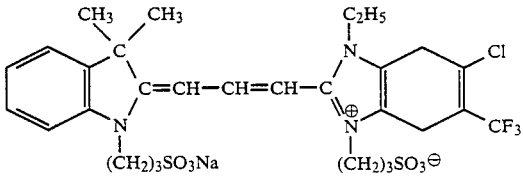

(C-6)

-continued (C-7)

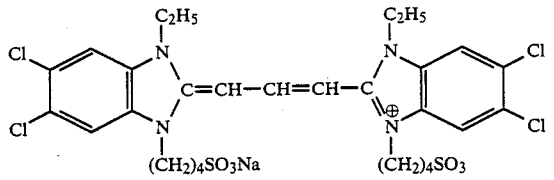

(C-8)

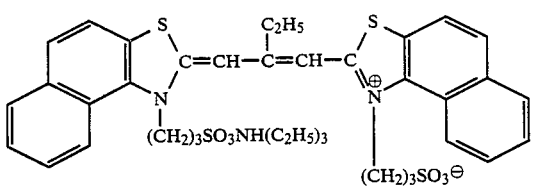

(C-9)

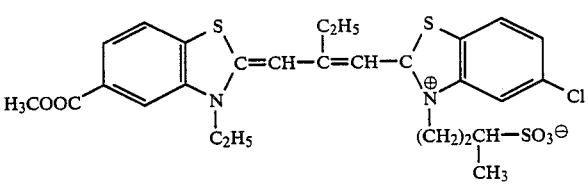

These sensitizing dyes are mere examples and the invention is not limited thereto.

The amount added of the sensitizing dye is $10^{-6}$ to $10^{-3}$, preferably $5\times10^{-6}$ to $5\times10^{-4}$, mole per mole of silver halide. The sensitizing dye can be dispersed directly in the emulsion or, alternatively, first dissolved in water-miscible solvents such as methanol, ethanol, pyridine, methyl "Cellosolve", acetone, dimethylformamide, and mixtures thereof, then diluted with or dissolved in water, and the resulting solution is added to the emulsion. In adding such a solution to the emulsion, the ultrasonic vibration can be applied, or the techniques described in U.S. Pat. No. 3,469,987 and Japanese Patent Publication No. 24,185/71 or those described in U.S. Pat. Nos. 2,912,345, 3,342,605, 2,996,287, and 3,425,835 can be used. The sensitizing dyes are used each alone or in mixtures of two or more dyes. Other dyes can also be included. The sensitizing dyes are added at any time from the preparation of silver halide emulsion and before coating the emulsion.

Typical examples of the compounds represented by the aforementioned general formula (D) are listed below.

(D-1) 4-Hydroxy-5-ethyl-6-methyl-1,3,3a,7-tetraazaindene.

(D-2) 2,6-Dimethyl-4-hydroxy-5-ethyl-1,3,3a,7-tetraazaindene.

(D-3) 4-Hydroxy-6-phenyl-1,3,3a,7-tetraazaindene.

(D-4) 4-Hydroxy-6-butyl-1,3,3a,7-tetraazaindene.

(D-5) 4-Hydroxy-6-hexyl-1,3,3a,7-tetraazaindene.

(D-6) 4-Hydroxy-5-amyl-6-methyl-1,3,3a,7-tetraazaindene.

(D-7) 4-Hydroxy-5-hexyl-6-methyl-1,3,3a,7-tetraazaindene.

(D-8) 4-Hydroxy-2-hydroxymethyl-6-methyl-6-phenyl-1,3,3a,7-tetraazaindene.

(D-9) 4-Hydroxy-6-phenyl-1,2,3a,7-tetraazaindene.

The compound represented by the general formula (D) bears one or more alkyl or aryl groups as the substituent of 3 to 8, preferably 4 to 7, carbon atoms. The amount to be added of the compound is generally $10^{-4}$ to $10^{-1}$, preferably $5\times10^{-4}$ to $5\times10^{-2}$, mole per mole of silver halide. The compounds are added at any time, generally after desalting.

The photographic emulsion of this invention can be sensitized also with quaternary ammonium salts, thioether compounds, polyethylene oxide derivatives, and diketones as described in U.S. Pat. Nos. 2,708,162, 3,046,132, 3,046,133, 3,046,134, and 3,046,135, and Brit. Patent 939,357.

The binders or protective colloids chiefly used in the photographic emulsion of this invention include lime-treated or acid-treated gelatin, gelatin derivatives such as phthalated gelatin, and polyvinyl alcohol. Such binders can also be used jointly with polyvinyl pyrrolidone, water-soluble acrylic copolymers, and polysaccharides such as starch, starch derivatives, and cellulose derivatives. It is also possible to modulate the physical properties of gelatin film by adding polymer latices and to impart a matte surface by the addition of starch grains, colloidal silica, and powdered glass.

The photograhic emulsion of this invention can contain hardeners. As examples of hardeners, mention may be made of aldehyde compounds such as formaldehyde and glutaraldehyde; ketone compounds such as diacetyl and cyclopentenediol; bis(2-chloroethylurea)-2-hydroxy-4,6-dichloro-1,3,5-triazine; reactive halogen compounds and divinylsulfone described in U.S. Pat. No. 3,288,775; reactive olefin compounds described in U.S. Pat. No. 3,635,718; N-methylol compounds described in U.S. Pat. No. 2,732,316; isocyanates described in U.S. Pat. No. 3,103,437; aziridine compounds described in U.S. Pat. Nos. 3,017,280 and 2,983,611; carbodiimide compounds described in U.S. Pat. No. 3,100,704; epoxy compounds described in U.S. Pat. No. 3,091,537; halogenocarboxyaldehydes such as mucochloric acid; dioxane derivatives such as dihydroxydioxane; and inorganic hardeners such as chrome alum. Mixtures of these hardeners may also be used.

The photographic emulsion of this invention may contain coating aids or surface active agents for the purpose of improving the wetting effect by decreasing the surface tension. As effective coating aids, there may be mentioned saponine, nonionic surfactants of the alkylene oxide base, glycerol base, and glycidol base;

cationic surfactants such as higher alkylamines, quaternary ammonium salts, pyridine, other heterocyclics sulfoniums; anionic surfactants having acid groups such as carboxylic acid, sulfonic acid, phosphoric acid, sulfate ester groups, and phosphate ester groups; amphoteric surfactants such as amino acids, aminosulfonic acids, and amino alcohol esters; and fluorinated surfactants described in Japanese Patent Publication No. 9,303/72, U.S. Pat. No. 3,589,906, Offenlegungsschrift (West Germany) 1,961,638 and 2,124,262.

The photographic emulsion of this invention may further contain developing agetns such as 1-phenylpyrazolidones and metols in addition to the compounds of aforementioned general formula (A).

The supports, upon which the emulsion of this invention is coated, are subject to no special restriction and include film bases such as polyester film and cellulose triacetate film; paper bases such as baryta paper, resin-treated paper, and laminated paper; glass support for dry plate; and metal supports.

If necessary, there may be provided an undercoat layer, intermediate layer, protective layer, and backing layer.

The invention is further illustrated in detail with reference to the following Examples, but the invention is not limited thereto.

EXAMPLE 1

A photographic emulsion was prepared according to the following formula:

| | | |
|---|---|---|
| I | Gelatin | 60 g |
| | Sodium chloride | 12 g |
| | Water | 400 ml |
| II | Silver nitrate | 120 g |
| | Water | 1,000 ml |
| III | Potassium bromide | 85 g |
| | Potassium iodide | 1.2 g |
| | 28% aqueous ammonia | 100 ml |
| | Water | 900 ml |
| IV | Acetic acid | |

To solution I, maintained at 50° C. and vigorously stirred, was added solution II. After 1 minutes, to the resulting mixture, was added solution III. The mixture was kept at 50° C. for 60 minutes to effect ripening, then adjusted to pH 3 by the addition of solution IV to obtain a silver iodobromide emulsion of 0.62 μm in average grain size. After desalting and washing with water, the emulsion was redissolved, mixed with gelatin, and adjusted to pH 6.0. To the resulting emulsion, were added 20 mg of sodium thiosulfate and 10 mg of chloroauric acid per mole of silver halide. The emulsion was kept at 60° C. for 60 minutes to effect chemical ripening. The emulsion was then adjusted to pH 5.5 and divided into four equal portions. To each portion were added compound (A-1) and compound (B-1) in amounts (per mole of silver halide) shown in Table 2, then followed by a hardener and a surface active agent. Each emulsion was coated on a polyethylenecoated paper support at a silver coverage of 2.2 g/m$^2$ and overcoated with a protective gelatin solution.

Each sample thus prepared was cut to a suitable size, exposed for $10^{-5}$ second to a flash light source through a wedge of 0.15 in density gradient, and developed in the following developer at 25° C. for 1 minute.

| | |
|---|---|
| Water (at about 30 ° C.) | 500 ml |
| Metol | 3.1 g |
| Hydroquinone | 12 g |
| Sodium sulfite, anhydrous | 45 g |
| Sodium carbonate, anhydrous | 67.5 g |
| Potassium bromide | 1.9 g |
| Made up with water to | 3,000 ml |

After development, each sample was passed through a stop bath, then fixing bath, and washed with water followed by drying. The results of test for the photographic characteristics were as shown in Table 3.

TABLE 2

| Sample | (A-1) | (B-1) |
|---|---|---|
| 1 | — | — |
| 2 | 0.10 | — |
| 3 | — | 0.05 |
| 4 | 0.10 | 0.05 |

TABLE 3

| Sample | Relative sensitivity S0.3 | Relative sensitivity S1.0 | γ | Dmax | Fog |
|---|---|---|---|---|---|
| 1 | 100 | 100 | 2.6 | 1.45 | 0.21 |
| 2 | 94 | 97 | 2.7 | 1.46 | 0.06 |
| 3 | 119 | 123 | 2.9 | 1.50 | 0.24 |
| 4 | 116 | 136 | 3.4 | 1.53 | 0.07 |

The relative sensitivity was expressed in terms of exposures (S0.3 and S1.0) necessary to produce densities of 0.3 and 1.0 (excluding the fog), assuming that the sensitivity of sample 1 is 100 in each case.

From the results shown in Table 3, it is seen that the sample 4 containing both compounds (A-1) and (B-1) exhibits a higher sensitivity (S1.0) at a high density than that (S0.3) at low density, that is, high contrast (γ), high maximum density (Dmax), and low fog.

COMPARATIVE EXAMPLE 1

The procedure of Example 1 was followed, except that the emulsion of the same composition was ripened at 40° C. for 6 minutes to produce a silver iodobromide emulsion of 0.4 μm in average grain size. The results of test were as shown in Table 4, wherein sample Nos. 1R to 4R correspond to respectively sample Nos. 1 to 4 of Table 1.

TABLE 4

| Sample | Relative sensitivity S0.3 | Relative sensitivity S1.0 | γ | Dmax | Fog |
|---|---|---|---|---|---|
| 1R | 100 | 100 | 2.9 | 1.51 | 0.18 |
| 2R | 97 | 98 | 2.9 | 1.49 | 0.05 |
| 3R | 100 | 102 | 3.1 | 1.52 | 0.20 |
| 4R | 98 | 101 | 3.1 | 1.51 | 0.05 |

It is seen from the results shown in Table 4 that the advantages obtained in Example 1 were substantially not obtained in the present case.

EXAMPLE 2

An emulsion of silver chlorobromide containing 5 mole-% of silver chloride was prepared by the ammonia process. In precipitating silver halide, $2\times10^{-7}$ mole of rhodium trichloride per mole of silver halide was used. The average grain size of silver halide was 0.75 μm.

After desalting and water washing, the emulsion was chemical ripened as in Example 1. After ripening, a stabilizer, sensitizing dye (C-3) ($1\times10^{-4}$ mole/mole silver), hardener, and surface active agent were added. The emulsion was divided into eight equal portions. Coating compositions were prepared by adding compounds of the general formulas (A) and (B) as shown in Table 5.

TABLE 5

| Sample | Compound of formula (A) (mole/mole Ag) | Compound of formula (B) (mole/mole Ag) |
|---|---|---|
| a | — | — |
| b | A-2 (0.2) | — |
| c | — | B-1 (0.075) |
| d | A-2 (0.2) | B-1 (0.075) |
| e | A-2 (0.2) | B-5 (0.075) |
| f | A-2 (0.2) | B-12 (0.075) |
| g | A-6 (0.2) | B-10 (0.075) |
| h | A-12 (0.1) | B-12 (0.075) |

Each coating composition was coated in the same manner as in Example 1, then dried, exposed, and developed. The results of test were as shown in Table 6.

TABLE 6

| Sample | Relative sensitivity S0.3 | Relative sensitivity S1.0 | γ | Dmax | Fog |
|---|---|---|---|---|---|
| a | 100 | 100 | 3.8 | 1.42 | 0.09 |
| b | 100 | 102 | 3.8 | 1.42 | 0.02 |
| c | 125 | 134 | 4.3 | 1.53 | 0.11 |
| d | 122 | 144 | 4.6 | 1.57 | 0.02 |
| e | 120 | 141 | 4.6 | 1.56 | 0.02 |
| f | 121 | 148 | 4.7 | 1.58 | 0.02 |
| g | 122 | 140 | 4.5 | 1.55 | 0.02 |
| h | 119 | 135 | 4.6 | 1.55 | 0.02 |

EXAMPLE 3

Emulsions were prepared by adding each of the compound (D-6) and reference compounds A and B to the emulsion used in sample d of Example 2, as shown in Table 7.

TABLE 7

| Emulsion | (D-6) mole/mole Ag | Reference compound mole/mole Ag |
|---|---|---|
| d | — | — |
| i | $5\times10^{-3}$ | — |
| j | — | A $5\times10^{-3}$ |
| k | — | B $5\times10^{-3}$ |

Note: Reference compound A: 4-Hydroxy-6-methyl-1,3,3a,7-tetraazaindene.
Reference compounds B: 1-Phenyl-5-mercapto-tetrazole.

The resulting emulsion was treated in the same manner as in Example 1. The test results obtained were as shown in Table 8. The relative sensitivity was determined by assuming the S1.0 value of sample d immediately after preparation to be 100.

TABLE 8

| Sample | Immediately after coating S1.0 | Immediately after coating Fog | Stored emulsion S1.0 | Stored emulsion Fog |
|---|---|---|---|---|
| d | 100 | 0.02 | 104 | 0.06 |
| i | 98 | 0.02 | 100 | 0.03 |
| j | 98 | 0.02 | 101 | 0.05 |
| k | 85 | 0.02 | 74 | 0.02 |

What is claimed is:

1. A silver halide photographic emulsion comprising as major constitutent silver bromide of 0.5 μm or above in averge grain size, which contains at least one of the compounds represented by the general formula

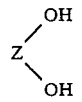

(A)

wherein Z represents an aromatic hydrocarbon group, or of the oxidized derivatives thereof, and at least one of the compounds represented by the general formula

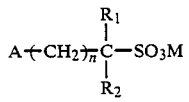

(B)

wherein A represents a hydroxyl group, an amino group,

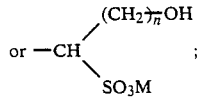

$R_1$ and $R_2$ form a ring jointly with the carbon atom to which $R_1$ and $R_2$ are attached or one of $R_1$ and $R_2$ represents a hydrogen atom and the other represents a hydrogen atom, an alkyl group, an aryl group, or a hydroxyl group; n is 0 or an integer of 1 to 8, and M represents a hydrogen atom, ammonium or an alkali metal.

2. An emulsion according to claim 1, wherein the emulsion is spectrally sensitized with a sensitizing dye of the general formula

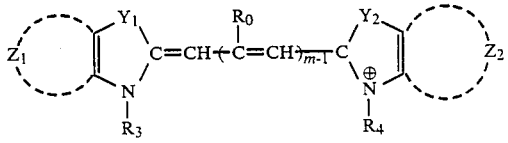

(C)

wherein $Y_1$ and $Y_2$ each represents an oxygen, sulfur, or selenium atom, a $>N\text{-}R_5$ group, $R_5$ being an alkyl group, or a

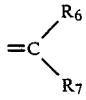

group, $R_6$ and $R_7$ being each an alkyl group; $R_0$ represents a hydrogen atom, an aryl group, an aralkyl group, or an alkyl group; $R_3$ and $R_4$ each represents an alkyl group, an aryl group, or an allyl group, which groups may be substituted, at least one of $R_3$ and $R_4$ having a sulfo group as substituent; $Z_1$ and $Z_2$ each represents a group of non-metallic atoms necessary for forming a benzene nucleus or a naphthalene nucleus, which nuclei may be substituted; and m is 1 or 2.

3. An emulsion according to claim 2, wherein the emulsion further contains a compound of the general formula (D)

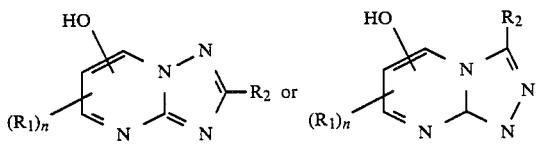

wherein $R_1$ and $R_2$ each represents a hydrogen atom, an aliphatic group, or an aromatic hydrocarbon group, provided that at least one of $R_1$ and $R_2$ is an aryl group or an alkyl group and the total number of carbon atoms of $R_1$ and $R_2$ is 3 to 8, and n is 1 or 2.

4. An emulsion according to claim 1, wherein the silver bromide content of the silver halide is 80 to 100 mole-%.

5. An emulsion according to claim 3, wherein the total number of carbon atoms of $R_1$ and $R_2$ is 4 to 7.

6. An emulsion according to claim 1, wherein the compound represented by the general formula (A) is contained in an amount of 0.05 to 0.3 mole per mole of the silver halide.

7. An emulsion according to claim 1, wherein the compound represented by the general formula (B) is contained in an amount of 0.003 to 0.3 mole per mole of silver halide.

8. An emulsion according to claim 3, wherein the compound represented by the general formula (D) is contained in an amount of $5\times10^{-4}$ to $5\times10^{-2}$ mole per mole of silver halide.

9. An photographic element which comprises a support and a photographic layer comprising the silver halide emulsion of claim 1.

10. An emulsion according to claim 7 wherein the compound represented by the general formula (A) is present in an amount of 0.05 to 0.3 mole per mole of the silver halide.

11. An emulsion according to claim 2 wherein each alkyl group is a lower alkyl group and each aryl group is a phenyl group.

12. An emulsion according to claim 3 where each alkyl group is a lower alkyl group and each aryl group is a phenyl group.

13. An emulsion according to claim 12 wherein the compound of formula (A) is present in an amount of 0.05 to 0.3 mole per mole of the silver halide and the compound of formula (B) is present in an amount of 0.003 to 0.3 mole per mole of silver halide.

* * * * *